US005226820A

United States Patent [19]

Pearson

[11] Patent Number: 5,226,820

[45] Date of Patent: Jul. 13, 1993

[54] BICYCLE RIDING TRAINING DEVICE

[76] Inventor: Larry C. Pearson, 110 E. Ravine Baye Rd., Milwaukee, Wis. 53217

[21] Appl. No.: 922,012

[22] Filed: Jul. 29, 1992

[51] Int. Cl.[5] ..... A63B 21/02

[52] U.S. Cl. ..... 434/247; 434/255; 482/57; 482/63; 482/124

[58] Field of Search ..... 482/51, 57, 63, 66, 482/69, 74, 122, 124, 125, DIG. 4; 434/247, 255

[56] References Cited

U.S. PATENT DOCUMENTS

| | | | |
|---|---|---|---|
| 4,040,620 | 8/1977 | Friedman | 482/125 |
| 4,073,490 | 2/1978 | Feather | 482/69 X |
| 4,251,071 | 2/1981 | Norton | 482/125 |
| 4,772,014 | 9/1988 | Rebman | 482/74 X |
| 4,852,874 | 8/1989 | Sleichter, III et al. | 482/122 |
| 4,887,584 | 12/1989 | Carella | 482/122 X |

*Primary Examiner*—Gene Mancene
*Assistant Examiner*—L. Thomas
*Attorney, Agent, or Firm*—Leydig, Voit & Mayer

[57] ABSTRACT

A training device for teaching children to ride a bicycle comprising a handle, a loop portion for selectively engaging the child's waist, and means for adjusting the size of the loop portion. The loop portion is placed over the head and shoulders of the child and placed around the child's waist. The adjusting means is adjusted so that the loop portion snugly and firmly engages the child's waist so that when the parent holds the handle, the parent can support and control the balance of the child as the child rides the bicycle. In one embodiment, the training device has an elongated member having first and second ends. The first and second ends are coupled together to form the handle and the loop portion therebetween. The first and second ends can be coupled together using any conventional means including, for example, Velcro hook and loop devices, extrusion or molding techniques, glue, or sturdy tape. In the second embodiment, the training device comprises an elongated member having a first end forming the handle and a second end coupled to the adjusting means. The adjusting means comprises a clasp which slidably engages the outer diameter of the elongated member. As the clasp slides towards the handle, the size of loop portion is increased and, as the clasp slides away from the handle, the size of the loop portion is decreased.

11 Claims, 2 Drawing Sheets

BICYCLE RIDING TRAINING DEVICE

FIELD OF THE INVENTION

The present invention relates generally to bicycles and, more particularly, to a training device for teaching people to ride a bicycle.

BACKGROUND OF THE INVENTION

Although many people take it for granted, teaching a person, especially a young child, to ride a two-wheeled bicycle can be very difficult. Young children lack the necessary coordination, balance and confidence to properly ride a bicycle.

Typically, young children first learn to ride three-wheeled tricycles or four-wheeled vehicles. These toys are relatively easy for young children to ride without any instruction because they have an adequate base which is difficult to over-balance or overturn. In order to ride these toys, the children simply sit in the seat and rotate the pedals without worrying about over-balancing themselves and falling. The children quickly gain confidence and master the intricacies, which although they may seem minor to adults, are monumental in young children's short development.

In order to ride a bicycle, however, the children must learn to naturally balance themselves as they pedal the bicycle without any means for supporting themselves. It will be appreciated that the pedaling action causes the children's center of balance to continuously shift, thereby causing the children to over-balance themselves and fall. It is only when the children learn to simultaneously control their balance and pedaling that they can ride a bicycle unaided and without some means for supporting themselves. In addition, the faster children learn to "self-right" their balance and control their balance, the faster they learn to ride a bicycle.

Two methods are typically used to teach children to properly balance themselves while riding a bicycle. First, the bicycle is provided with two training wheels located on each side of the rear wheel. Although this method has been used for years, it can be relatively ineffective because the children tend to "cheat" by riding on three wheels—the two bicycle wheels and one of the training wheels. The presence of the training wheels makes it relatively awkward and cumbersome to store or transport the bicycle. Not only are the training wheels difficult and time-consuming to assemble, but they are expensive to manufacture because they must be individually designed to fit bicycles of different sizes.

In the second method, the children pedal the bicycle pedals as the parent runs along the side of the bicycle, while holding the bicycle seat and essentially supporting the entire weight of the child and the bicycle. This teaching method also has disadvantages. First, it may take children a relatively lengthy time to learn to ride by themselves because parents tend to over-compensate by supporting too much of the children's weight, thereby preventing the children from learning to naturally control their balance and self-right themselves. In addition, parents may become fatigued from the constant exertion of bending down to hold the bicycle seat and running along the side of the bicycle for substantial distances. Thus parents may actually over-balance the children.

OBJECTS AND SUMMARY OF THE INVENTION

It is an object of the present invention to provide a training device for teaching young children to ride a bicycle.

It is another object to provide a training device which permits children to quickly and safely learn to naturally balance themselves as they ride the bicycle.

It is another object to provide a training device which permits parents to remain level without having to bend over while controlling and supporting the child and the bicycle.

It is another object to provide a safe training device which permits parents to support the entire weight of a young child when the child falls off the bicycle.

In accordance with the objects of the present invention, a training device for teaching children to ride a bicycle is provided. The training device comprises a handle, a loop portion for selectively engaging the child's waist, and means for adjusting the size of the loop portion. After the loop portion is placed over the head and shoulders of the child, the adjusting means is adjusted so that the loop portion snugly and firmly engages the child's waist so that, when the parent holds the handle, the parent can support and control the balance of the child as the child rides the bicycle.

In one embodiment, the training device has an elongated member having first and second ends. The first and second ends are coupled together to form the loop portion therebetween. The first and second ends can be coupled together to form the handle using any conventional means including, for example, Velcro hook and loop devices, extrusion or molding techniques, glue, or sturdy tape. The adjusting means comprises a tubular clasp which slidably engages the outer diameter of the first and second ends of the elongated member. As the clasp slides towards the handle, the size of the loop portion is increased and, as the clasp slides away from the handle, the size of the loop portion is decreased.

In the second embodiment, the training device comprises an elongated member having a first end forming the handle, and a second end coupled to the adjusting means. The adjusting means comprises a first end which is coupled to the second end of the elongated member and a second end forming a tubular clasp which slidably engages the exterior of the elongated member between the first and second ends of the elongated member. As the clasp slides towards the first end of the elongated member, the size of loop portion is increased and, as the clasp slides away from the first end of the elongated member, the size of the loop portion is decreased.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 5 is a side view of another embodiment of the clasp having an adjustable inner diameter.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
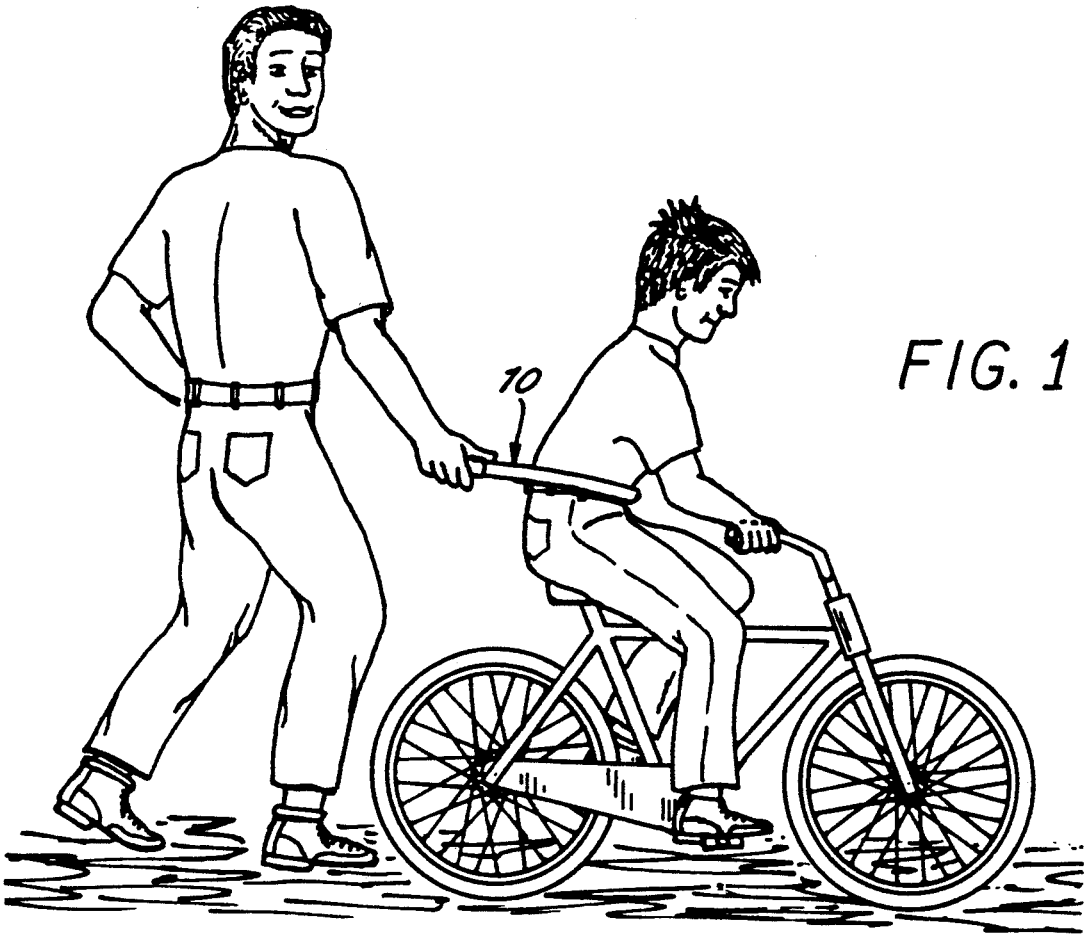
FIG. 1 is a perspective view illustrating a parent teaching a young child to ride a bicycle using the training device made in accordance with the present invention.
Figure 2:
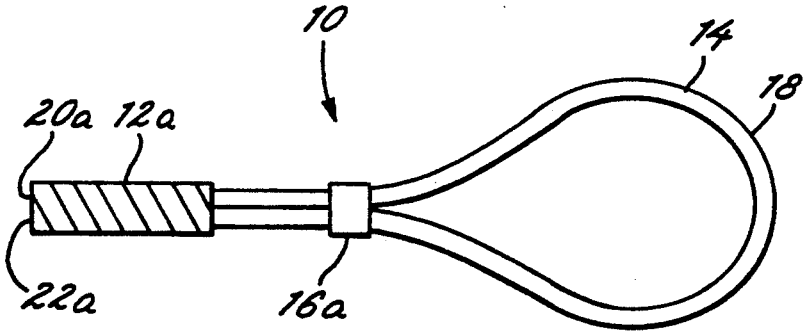
FIG. 2 is a view of a first embodiment of the bicycle riding training device made in accordance with the present invention.
Figure 3:
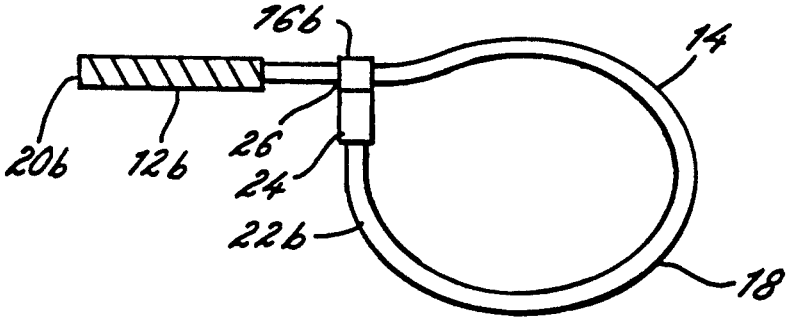
FIG. 3 is a view of a second embodiment of the bicycle riding training device made in accordance with the present invention.

Referring to the figures, FIGS. 1–3 illustrate a bicycle riding training device 10 made in accordance with the present invention which permits a parent to teach a child to quickly, easily and safely ride a bicycle. FIGS. 2–3 illustrate two embodiments of the training device 10, respectively. In both embodiments, the training device 10 comprises a handle 12 connected to a loop portion 14. Since the loop portion 14 must be large enough to fit over the head and shoulders of the child and also snugly engage the child's waist, means are provided for adjusting the size of the loop portion 14.

In the first embodiment illustrated in FIG. 2, the device 10 comprises an elongated member 18 having first and second ends 20, 22 which are coupled together to form the handle 12 at one end and the loop portion 14 at the other end. The first and second ends 20, 22 can be coupled together using any conventional technique including for example, Velcro hook and loop devices, extrusion or molding techniques, glue or sturdy tape. The adjusting means comprises a tubular clasp 16 which slidably engages the outer diameter of the first and second ends 20, 22 of the elongated member 18. The size of the loop portion 14 can be decreased by sliding the clasp 16 away from the handle 12 and towards the loop portion 14. In a similar manner, the size of the loop portion 14 can be increased by sliding the clasp 16 towards the handle 12. It will be appreciated that the adjusting means permits the loop portion 14 to be adjusted to fit over the head and shoulders of the child, or to snugly engage the child's waist.

In a second embodiment illustrated in FIG. 3, the training device 10 comprises an elongated member 18 having a first end **20*b* and a second end 22*b*. The handle 12*b* is located at the first end 20*b*. The adjusting means comprises a clasp 16*b* having a first end 24 and a second end 26. The first end 24 of the clasp 16 is rigidly connected to the second end 22*b* of the elongated member 18. The second end 26 is a tubular member adapted to engage the outer diameter of the elongated member 18 between the first end 20*b* and the second end 22*b*. The size of the loop portion 14 can be decreased and increased by sliding the clasp 16*b* between the first and second ends 20*b*, 22*b* of the elongated member 18**.

In order to enhance the parent's ability to hold the handle 10 and support the child, the handle 10 may have a non-slip surface such as tape or a plurality of projections protruding from its surface.

Since the parent will be teaching the child to properly balance himself, it will be appreciated that the elongated member 18 must be rigid enough so that the parent can adjust the child's center of balance by pulling or pushing the child's waist, thereby keeping the child centered over the middle of the bicycle. At the same time, it will be appreciated that not only must the elongated member 18 be made of a material which has enough strength and rigidity to ensure that the parent can support the weight of the child in the event that the child loses his balances and falls off the bicycle, but it must also be soft and pliant enough to fit around the child without hurting the child or being uncomfortable. In this regard, the elongated member 18 may have any cross-sectional shape, but a cylindrical cross section has been found to be effective because it firmly yet comfortably engages the child's waist. Other cross-sections may be used including, for example, oval or rectangular cross sections. It has been found that an elongated member made of vulcanized rubber from about ⅝ inch to about one inch in diameter and from about 4 feet to about 4½ feet in length is satisfactory. However, any material may be used which fulfills the purpose of the training device 10. When the first and second ends 20, 22 of the elongated member 18 are coupled together, the overall length of the training device is about 22½ feet in length which satisfactorily permits the parent to run behind the child on the bicycle.

Figure 4:
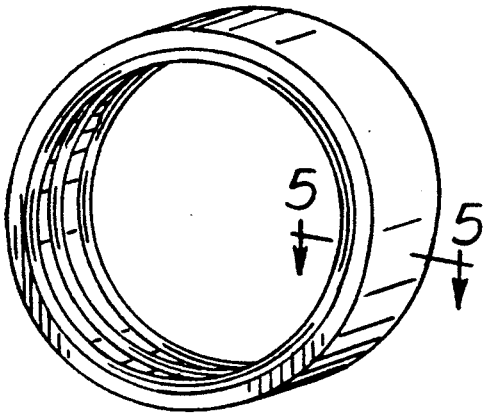
FIGS. 4 and 5 are views of one embodiment of the clasp having teeth disposed along the inner diameter.
Figure 5:
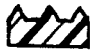
Figure 6:
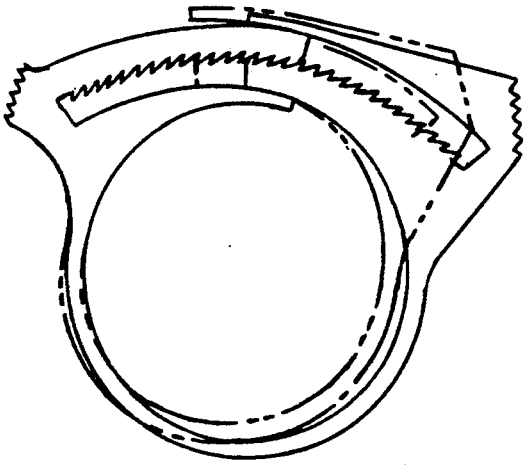

Although in the illustrated embodiments, the adjusting means is formed by a clasp member 16, the adjusting means can be comprised of a member having any shape or size as long as it can selectively slide along the elongated member 18 to adjust the size of the loop portion 14. In the illustrated embodiment, the inner diameter of the clasp 16 is slightly larger than the outer diameter of the elongated member 18 so that the frictional forces between the inner diameter of the adjusting means and the exterior diameter of the elongated member 18 will maintain the position of the adjusting means along the length of the elongated member 18 once the size of the loop portion 14 is selected. Since only the frictional forces maintain the position of the adjusting means and the size of the loop portion 14, even a young child can remove the training device 10, if necessary. In another embodiment (shown in FIGS. 4 and 5), the clasp 116 may have a plurality of teeth **116*a* which slightly protrude from the inner diameter of the tubular clasp 116 for engaging the exterior of the elongated member 18 and holding the clasp 116 and the loop portion 14 in a selected position. When the loop portion 14 engages the child's waist, it will be appreciated that the ends of the loop portion 14 will deform, thereby enhancing the seal between the teeth 116*a* and the exterior of the elongated member 18. In another embodiment (shown in FIG. 6), the tubular clasp 116*b* can have an inner diameter which is adjustable by any conventional means so that the adjusting means of the clasp 16 can be tightened around the exterior of the elongated member 18. It will be appreciated that the clasp 16** may be made of plastic or metal, may be rigid or flexible, and may be manufactured by any conventional technique, including for example, extrusion or molding.

To use the device 10 to teach a child to ride a bicycle, the loop portion 14 is opened to its largest position by sliding the clasp 16 toward the handle 12 and placing the loop portion 14 over the child's head and shoulders so that it engages the child's waist. After it engages the child's waist, the adjusting means is adjusted by sliding the clasp 16 away from the handle 12 and toward the child, thereby decreasing the size of the loop portion 14 so that the loop portion 14 snugly engages the child's waist without hurting the child or unduly restricting the child's movement and balance. As the child pedals the bicycle as illustrated in FIG. 1, the parent can maneuver along the side and toward the rear of the bicycle while holding the handle 12 and simultaneously controlling the child's balance with the aid of the training device 10. The parent can maneuver the child's center of balance by pushing or pulling on the handle 12 of the training device 10, thereby keeping the child's center of balance over the middle portion of the bicycle and teaching the proper balance necessary to ride the bicycle. Since the parent is not directly supporting the bicycle, the child can feel the natural weight distribution on the bicycle. In addition, since the parent is safely supporting the child by the training device 10 and preventing the child from falling if the child should over-balance, the child can confidently adjust his weight to determine how it affects the operation of the bicycle which permits the child to quickly learn how to ride the bicycle properly.

It should now be appreciated that, in accordance with one of the objects of the invention, the training device 10 permits children to learn to ride a bicycle more quickly and more safely than the methods previously available. The training device 10 permits the parent to support the child and control the balance of the child without holding the seat of the bicycle, which only prevents the child from naturally controlling his balance. Since children only learn to ride the bicycle when they can continuously feel and control their balance, the training device may assist children to learn to ride more quickly than other methods. Even though the child is permitted to control his own balance, the training device 10 is still rigid and sturdy so that the parent can safely support the child in the event that the child loses his balance. It will also be appreciated that supporting the child with the training device 10 is safer than holding the bicycle seat because the training device 10 enables the parent to support and control the child without the fatigue associated with the constant exertion of bending down to the level of the bicycle seat while simultaneously running along side of the bicycle.

Furthermore, the training device 10 offers several other advantages over the traditional training wheel method. The training device 10 is less time consuming and costly to manufacture than the traditional training wheels. And unlike training wheels, the training device 10 does not have to be assembled and may be used with any bicycle design.

It will now be appreciated that the loop gives the parent more ability to control and balance the child on the bicycle which in turn gives the child more confidence and security, thereby enabling him to learn to ride more quickly and easily.

I claim as my invention:

1. A method for aiding a person in teaching a child to ride a bicycle using a device having an elongated member comprising a handle and a loop portion for engaging and supporting the body of the child and means for adjusting the size of the loop portion, the method comprising:

adjusting the size of the loop portion to its largest size so that it fits over the body of the child;

engaging the loop portion about the body of the child;

adjusting the size of the loop portion so that the loop portion snugly engages and supports the body of the child;

holding the handle and supporting the child as the child pedals the bicycle; and controlling the distribution of the child's weight over the bicycle so that the child learns to properly balance over the bicycle.

2. The invention as set forth in claim 1 wherein the elongated member has first and second ends which are coupled together forming the handle at the one end and the loop portion at the other end.

3. The invention as set forth in claim 2 wherein the adjusting means comprises a tubular clasp for slidably engaging the outer diameter of the first and second ends of the elongated member for selecting the size of the loop by sliding the clasp towards the handle for increasing the loop size and towards the loop portion end for decreasing the loop size.

4. The invention as set forth in claim 3 wherein the tubular clasp has an inner diameter which is slightly larger than the outer diameter of the coupled first and second ends of the elongated member so that the frictional forces generated by between the inner diameter of the clasp and the elongated member maintain the selected size of the loop portion.

5. The invention as set forth in claim 3 wherein the tubular clasp has an inner diameter and teeth projecting from the inner diameter for engaging the outer diameter of the coupled first and second ends of the elongated member for maintaining the selected size of the loop portion.

6. The invention as set forth in claim 3 wherein the tubular clasp has an adjustable inner diameter for engaging the outer diameter of the coupled first and second ends of the elongated member and maintaining the selected size of the loop portion.

7. The invention as set forth in claim 1 wherein the elongated member has first and second ends, the first end forming the handle and the second end attached to the adjusting means.

8. The invention as set forth in claim 4 wherein the adjusting means comprises a first end attached to the second end of the elongated member and a second end having a tubular clasp for slidably engaging the elongated member between the first and second ends of the elongated member.

9. The invention as set forth in claim 8 wherein the tubular clasp has an inner diameter which is slightly larger than the outer diameter of the second end of the elongated member so that the frictional forces generated by between the inner diameter of the clasp and the elongated member maintain the selected size of the loop portion.

10. The invention as set forth in claim 8 wherein the tubular clasp has an inner diameter and teeth projecting from the inner diameter for engaging the outer diameter of the first end of the elongated member for maintaining the selected size of the loop portion.

11. The invention as set forth in claim 8 wherein the tubular clasp has an adjustable inner diameter for engaging the outer diameter of the first end of the elongated member and maintaining the selected size of the loop portion.

* * * * *